US011096425B2

(12) United States Patent
Chen et al.

(10) Patent No.: US 11,096,425 B2
(45) Date of Patent: Aug. 24, 2021

(54) HEATING DEVICE, ATOMIZER AND ELECTRONIC CIGARETTE HAVING SAME

(71) Applicant: Shenzhen First Union Technology Co., Ltd., Shenzhen (CN)

(72) Inventors: Xue Chen, Shenzhen (CN); Yunkai Zhang, Shenzhen (CN); Zhongli Xu, Shenzhen (CN); Yonghai Li, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 176 days.

(21) Appl. No.: 16/355,741

(22) Filed: Mar. 16, 2019

(65) Prior Publication Data

US 2019/0281895 A1 Sep. 19, 2019

(30) Foreign Application Priority Data

Mar. 16, 2018 (CN) ..... 201820365263.6

(51) Int. Cl.

| | |
|---|---|
| ***A24F 47/00*** | (2020.01) |
| ***A24F 40/44*** | (2020.01) |
| *A24F 40/10* | (2020.01) |
| *A24F 40/46* | (2020.01) |

(52) U.S. Cl.

CPC ..... *A24F 47/008* (2013.01); *A24F 40/44* (2020.01); *A24F 40/10* (2020.01); *A24F 40/46* (2020.01)

(58) Field of Classification Search

CPC ..... A24F 40/44

See application file for complete search history.

(56) References Cited

U.S. PATENT DOCUMENTS

| | | | | |
|---|---|---|---|---|
| 9,795,170 | B1 * | 10/2017 | Zhu | A24F 47/008 |
| 9,814,269 | B2 * | 11/2017 | Li | A24F 47/008 |
| 9,814,272 | B2 * | 11/2017 | Li | A24F 47/008 |
| 9,993,028 | B2 * | 6/2018 | Li | A24F 7/02 |
| 9,999,253 | B2 * | 6/2018 | Li | F16K 15/14 |
| 10,004,274 | B2 * | 6/2018 | Li | A61M 15/06 |
| 10,390,566 | B2 * | 8/2019 | Hu | H05B 3/46 |
| 10,537,138 | B2 * | 1/2020 | Li | A24F 40/40 |
| 10,568,358 | B2 * | 2/2020 | Li | A24F 47/008 |

(Continued)

FOREIGN PATENT DOCUMENTS

| | | |
|---|---|---|
| CN | 104 886 783 A | 9/2015 |
| CN | 104 068 476 B | 5/2017 |
| CN | 107 752 133 A | 3/2018 |

*Primary Examiner* — Ross N Gushi

(74) *Attorney, Agent, or Firm* — PROI Intellectual Property US

(57) ABSTRACT

A heating device, an atomizer and an electronic cigarette having the same are disclosed, a heating device includes a shell, with a receiving chamber formed therein; a heating element, received in the receiving chamber to contact with a liquid conductive body; the liquid conductive body, configured for absorbing tobacco liquid and supplying the tobacco liquid to the heating element; the liquid conductive body includes multiple annular liquid conductive layers stacked inside the shell, along an axial direction of the shell; outer diameters of multiple annular conductive layer are equal to an inner diameter of the receiving chamber such that the multiple annular liquid conductive layers are capable of being received in the receiving chamber and abutting against an inner surface of the shell.

19 Claims, 6 Drawing Sheets

(56) References Cited

U.S. PATENT DOCUMENTS

| | | | | |
|---|---|---|---|---|
| 10,645,975 | B2 * | 5/2020 | Qiu | A24F 40/46 |
| 10,661,032 | B2 * | 5/2020 | Li | A61M 11/041 |
| 10,709,172 | B2 * | 7/2020 | Jiang | A24F 40/485 |
| 10,721,966 | B2 * | 7/2020 | Li | A24F 47/002 |
| 10,786,636 | B2 * | 9/2020 | Zhao | A61M 11/042 |
| 2016/0143365 | A1 | 5/2016 | Liu | |
| 2016/0157522 | A1 * | 6/2016 | Zhu | A24F 40/46 131/329 |
| 2017/0049154 | A1 | 2/2017 | Batista | |
| 2017/0251729 | A1 * | 9/2017 | Li | A61M 15/06 |
| 2018/0027874 | A1 * | 2/2018 | Zhu | H05B 3/03 |
| 2018/0116287 | A1 * | 5/2018 | Dai | H05B 3/44 |
| 2018/0317558 | A1 * | 11/2018 | Qiu | A61M 11/042 |
| 2019/0159524 | A1 * | 5/2019 | Qiu | A24F 7/02 |
| 2019/0274356 | A1 * | 9/2019 | Deng | A24F 40/485 |
| 2019/0307168 | A1 * | 10/2019 | Zhao | A24F 40/10 |
| 2020/0054075 | A1 * | 2/2020 | Zhang | H05B 3/44 |
| 2020/0129710 | A1 * | 4/2020 | Zhang | A24F 40/44 |

* cited by examiner

HEATING DEVICE, ATOMIZER AND ELECTRONIC CIGARETTE HAVING SAME

TECHNICAL FIELD

The present disclosure relates to the field of electronic cigarettes, and particularly to a heating device, an atomizer and an electronic cigarette having same.

BACKGROUND ART

The electronic cigarettes containing tobacco liquid generates an aerosol mainly by a heating device heating the tobacco liquid, of which, the heating device mainly includes a liquid conductive body and a heating element; the tobacco liquid is transmitted via the liquid conductive body into the heating element for heating.

During invention process, a problem known to the inventors: the liquid conductive body is generally formed by winding multiple layers of non-woven fabrics. By replying on this, inventors are difficult to control thickness of the liquid conductive body. The more thick the liquid conductive body, the more hardship it has for being installed into a shell with a fixed size. If the liquid conductive body itself is too thin, after it has been installed into the shell, a seam is emerged between the liquid conductive body and the shell, resulting in leakage of the tobacco liquid, therefore deteriorating the yield of electronic cigarettes over time, exerting a detrimental influence such as low efficiency on automatic production over time.

SUMMARY

In view of the drawbacks in the prior art, the present disclosure relates to a heating device, an atomizer and an electronic cigarette having the same, which are capable of improving the yield of electronic cigarettes over time, and exerting a beneficial influence such high efficiency on automatic production over time.

In order to solve the above technical problem, the present disclosure provides a heating device according to independent claim 1 whereas various embodiments of an atomizer and improvements thereto are recited in the dependent claims. A heating device includes: a shell, with a receiving chamber formed therein; a heating element, received in the receiving chamber to contact with a liquid conductive body; the liquid conductive body, configured for absorbing tobacco liquid and supplying the tobacco liquid to the heating element; the liquid conductive body includes multiple annular liquid conductive layers stacked inside the shell, along an axial direction of the shell; outer diameters of the multiple annular liquid conductive layers are equal to an inner diameter of the receiving chamber such that the multiple annular liquid conductive layers are capable of being received in the receiving chamber and abutting against an inner surface of the shell.

Optionally, the annular liquid conductive layers are annular non-woven fabrics, and each annular non-woven fabric includes an air hole, multiple air holes of multiple non-woven fabrics intercommunicate to emerge as a first air passage extending an axial direction of the shell.

Optionally, the heating element is a heating coil.

The heating coil is disposed inside the first air passage.

Optionally, the heating element is a disk-shaped heating piece with a third air hole thereon.

The annular non-woven fabrics at least include a first annular non-woven fabric and a second annular non-woven fabric.

The disk-shaped heating piece is clamped between the first annular non-woven fabric and the second annular non-woven fabric, and the third air hole intercommunicate the first air passage.

Optionally, a liquid conductive hole is bored on a sidewall of the shell.

The liquid conductive hole contacts with the liquid conductive body and is configured for supplying tobacco liquid to the liquid conductive body.

Optionally, two ends of the shell respectively have a first air hole and a mounting hole, the first air hole and the mounting hole intercommunicate with the receiving chamber;

The heating device further includes: a compression member; the compression member is mounted in the mounting hole and abuts against one end of the liquid conductive body, configured for compressing the liquid conductive body to adjust a volume of the liquid conductive body.

Optionally, the shell further includes:

a annular stopper;

The annular stopper is disposed inside the receiving chamber, one end of the liquid conductive body abuts against the annular stopper, and an opposite end thereof abuts against the compression member; the first air hole is corresponding with a central hole of the annular stopper.

Optionally, the heating device further includes: a filtering net; the filtering net is disposed between the liquid conductive body and the annular stopper, corresponding with the annular non-woven fabrics, the filtering net is configured for preventing the tobacco liquid from flowing into the first through hole.

Optionally, the heating device further includes: an anode ring; the anode ring is connected with the compression member.

To solve the above problem, the present disclosure further provides an atomizer, includes a case and the aforementioned heating device; the case has a liquid storage chamber formed therein; the heating device is received in the case, such that the heating device is capable of receiving tobacco liquid from the liquid storage chamber and heating the tobacco liquid.

To solve the above problem, another technology scheme is adopted by the present disclosure; an electronic cigarette is provided including: a power supply module and the aforementioned atomizer; the atomizer is coupled with the power supply module via the heating element.

Additional aspects and advantages of the present disclosure will be: the present disclosure relates to a heating device, an atomizer and an electronic cigarette having same. The heating device includes: a shell, a heating element and a liquid conductive body. The shell has a receiving chamber formed therein. The heating element is received in the receiving chamber and contacts with the liquid conductive body. The liquid conductive body is configured for absorbing tobacco liquid and supplying the tobacco liquid to the heating element. The liquid conductive body includes multiple annular liquid conductive layer stacked inside the shell along an axial direction of the shell, by making the outer diameter of multiple annular liquid conductive layers equal to the inner diameter of the receiving chamber, the annular liquid conductive layers are capable to be received in the receiving chamber and abut against the inner wall of the shell, which reduces the phenomenon that the liquid conductive body is too thick or too thin, resulting in improving the yield of the electronic cigarettes over time and improving production efficiency.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

With reference to FIG. 1 to FIG. 6, 1 represents the heating device, 10 represents the shell, 11 represents the receiving chamber; 12 represents the liquid conductive hole; 13 represents the first air hole; 14 represents the mounting hole; 15 represents the clamping part; 16 represents the annular stopper; 161 represents the central hole; 20 represents the liquid conductive body; 21 represents the annular non-woven fabrics; 21*a* represents the first annular non-woven fabrics; 21*b* represents the second annular non-woven fabrics; 211 represents the air hole; 22 represents the first air pipe; 30 represents the heating element; 31 represents the anode terminal; 32 represents the cathode terminal; 33 represents the second air hole; 34 represents the third air hole; 40 represents the compression member; 41 represents the compression main body; 42 represents the connecting part; 43 represents the compression part; 44 represents the receiving hole; 50 represents the filtering net; 60 represents the cathode ring; 61 represents the cathode main ring; 611 represents the airflow hole; 62 represents the second air pipe.

DETAILED DESCRIPTION

Embodiment 1

Figure 1:
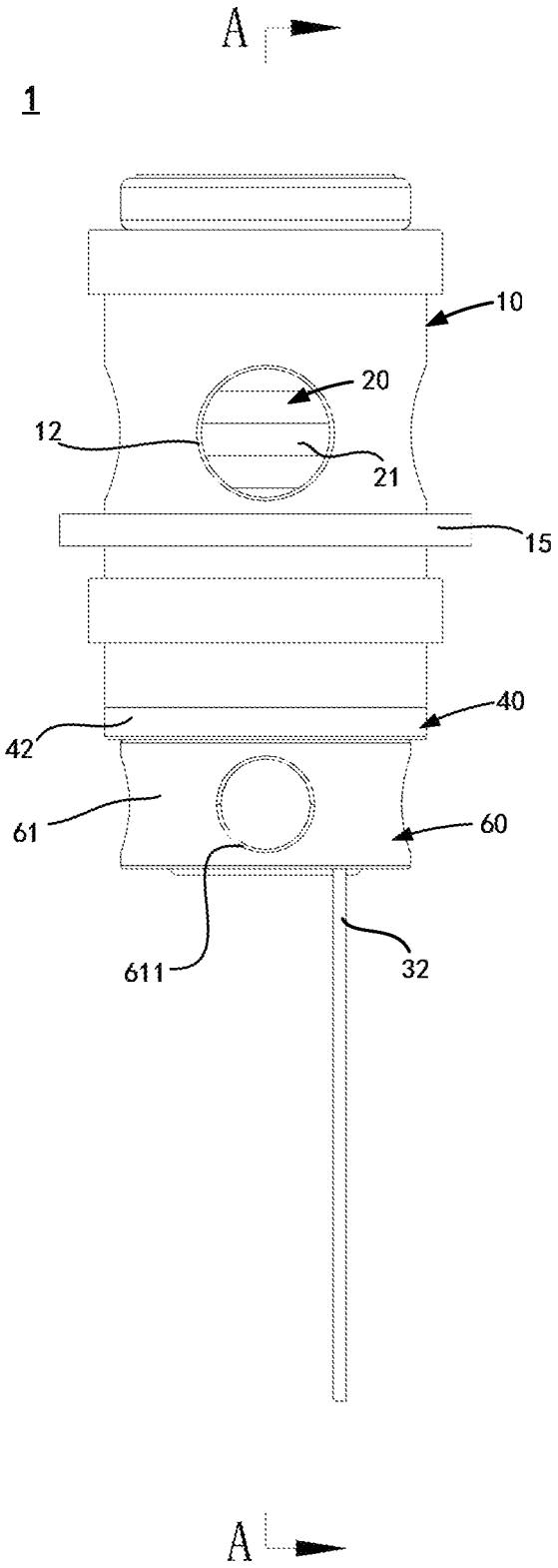
FIG. 1 is an aspect view of a heating device in accordance with a first embodiment of the present disclosure.
Figure 2:
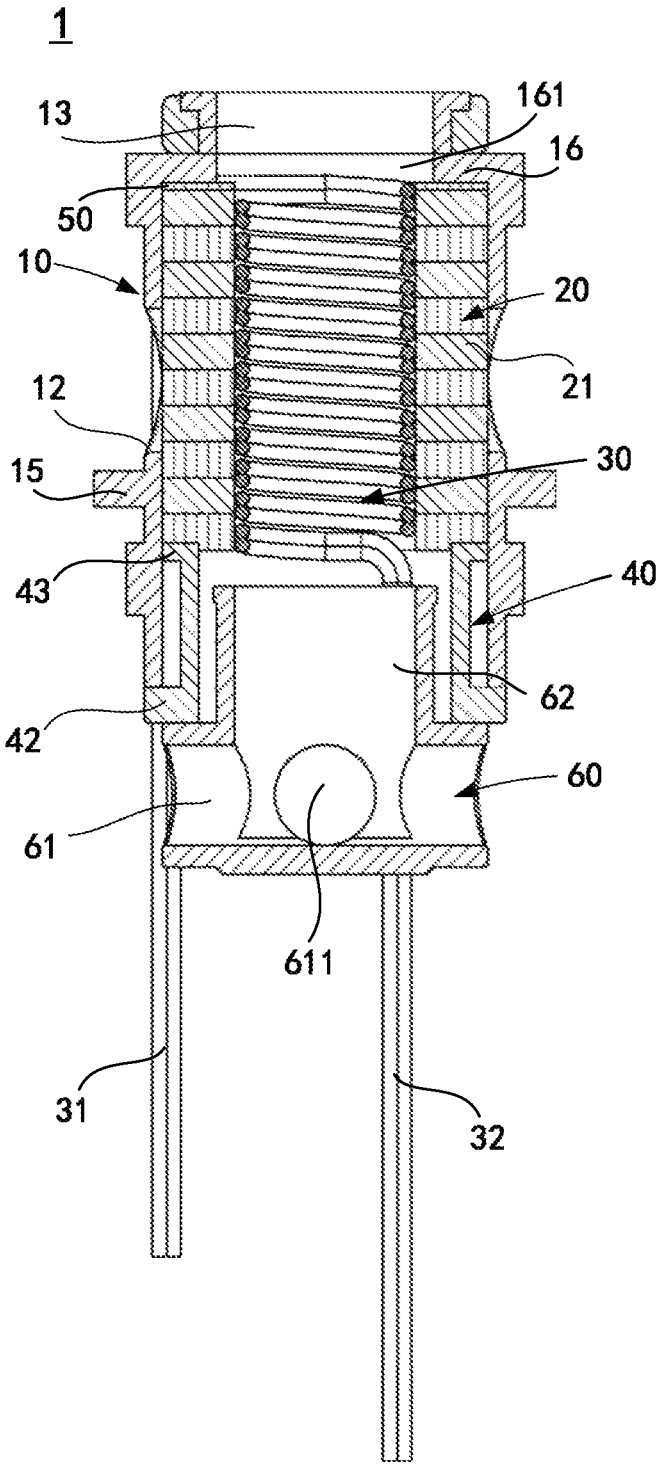
FIG. 2 is a cross-sectional view of the heating device along A-A direction in FIG. 1.
Figure 3:
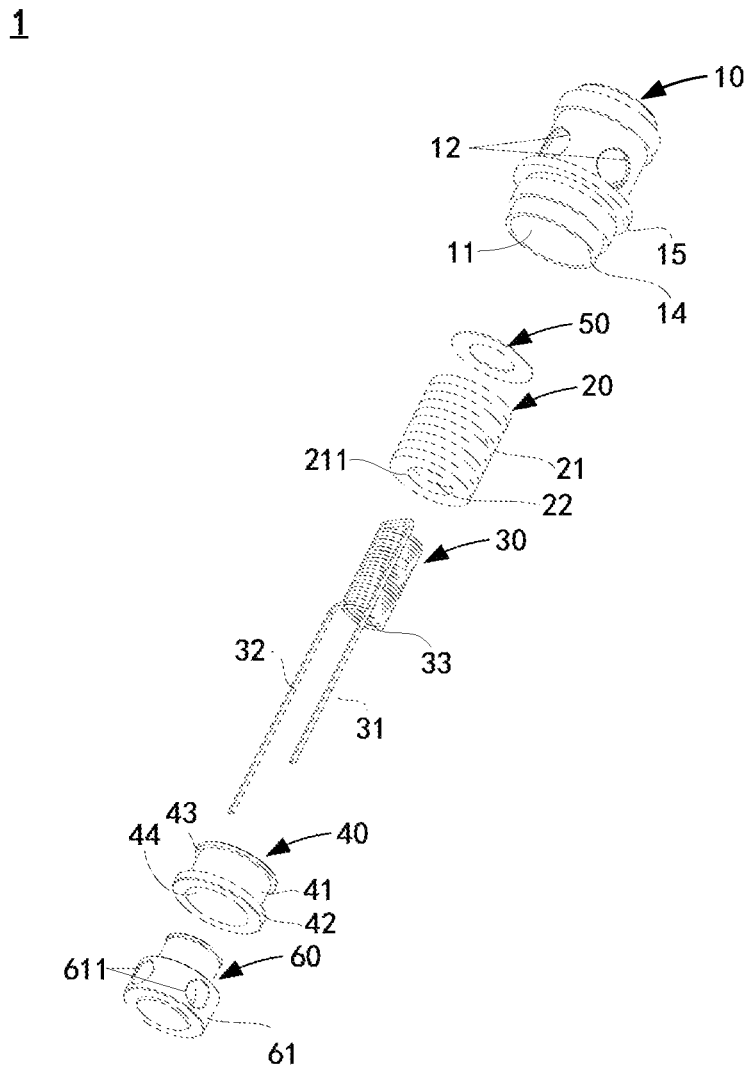
FIG. 3 is an exploded view of the heating device in FIG. 1.

As shown from FIG. 1 to FIG. 3, which illustrate the heating device in accordance with embodiments of the present disclosure. The heating device 1 applied to the atomizer, including: a shell 10, a liquid conductive body 20, a heating element 30, a compression part 40, a filtering net 50 and a cathode ring 60.

As shown in FIG. 2 and FIG. 3, the shell 10 is a tube-shaped structure in rotational symmetry. At a middle of the shell 10 is provided with a receiving chamber 11, a cross-section of the receiving chamber 11 is round to be coaxial with the shell 10. Alternatively, in other embodiments, the cross-section of the receiving chamber 11 is rectangular or other polygonal.

Two ends of the shell 10 are respectively bored with a first air hole 13 and a mounting hole 14, both intercommunicate with the receiving chamber 11, and the first air hole 13, the mounting hole 14 and the receiving chamber 11 are coaxial with each other, in which, a diameter of the first air hole 13 is less than that of the receiving chamber 11, the diameter of the mounting hole 14 is equal to that of the receiving chamber 11. Of course, in other alternative embodiments, the diameter of the first air hole 13 is also equal to that of the receiving chamber 11.

The sidewall of the shell 10 is also bored with multiple of the liquid conductive holes 12. The liquid conductive holes 12 are posited around the shell 10 symmetrically. Exterior tobacco liquid of the heating device 1 through the liquid conductive holes 12 flow into the heating device 1 for being heated to generate an aerosol. Preferably, the number of the liquid conductive holes 12 is four which allow the tobacco liquid to evenly flow into the heating device 1.

Furthermore, the sidewall of the shell 10 protrudes to form a clamping part 15, the clamping part 15 is located below the liquid conductive holes 12, emerging as a continuous protrusion. Of course, in some embodiments, the clamping part 15 may be made of multiple of protrusions, posited around the shell 10 symmetrically.

Furthermore, the shell 10 includes a annular stopper 16, the annular stopper 16 is posited closer to an end of the first air hole 13. The central hole 161 of the annular stopper 16 is corresponding with the first air hole 13.

The liquid conductive body 20, the heating element 30 and the filtering net 50 are all deposited in the receiving chamber 11, in which, an end of the liquid conductive body 20 is passing through the filtering net 50 to abut against the annular stopper 16. Moreover, when the liquid conductive body 20 is received in the receiving chamber 11, the liquid conductive body 20 contacts the liquid conductive holes 12, enabling exterior tobacco liquid of the heating device 1 to pass through the liquid conductive holes 12, flowing into the liquid conductive body 20 and temporally stored in the liquid conductive body 20, eventually transmitted to the heating element 30 for heating to generate an aerosol.

The compression member 40 is mounted in the mounting hole 14 of the shell 10, abutting against an opposite end of the liquid conductive body 20 to compress the liquid conductive body 20 so as to adjust the volume of the liquid conductive body 20. When assembled, after the liquid conductive body 20 is deposited in the receiving chamber 11, the liquid conductive body 20 is in a comparatively loose state. A this time, just mounting the compression member 40 into the mounting hole 14 can finish the compression of the liquid conductive body 20, which can simplify the assembling process of the liquid conductive body 20 to realize rapid assembly. Moreover, the assembling of the liquid conductive body 20 can be finished in automation equipment, which is beneficial for automation production and improving the efficiency thereof.

The cathode ring 60 is connected with the compression member 40.

As shown in FIG. 2 and FIG. 3, the liquid conductive body 20 is configured for absorbing tobacco liquid and supplying the tobacco liquid to the heating element 30, made of multiple annular liquid conductive layers stacked along an axial direction of the shell 10. The annular liquid conductive layers may be made by organic cottons, man-made fiber cottons, non-woven fabrics or micro polymer foam materials etc. More specifically, in the embodiment, the annular liquid conductive layer is formed by compressing annular non-woven fabrics 21 to a blocky-shape, in which, the middle of the annular non-woven fabrics 21 is bored with the air hole 211. When the annular non-woven fabrics 21 are stacked, the air hole 211 of each non-woven fabric 21 intercommunicates with each other to form the first air pipe 22 along an axial direction of the shell 10. When the liquid conductive body 20 made of stacked non-woven fabrics 21 is received in the receiving chamber 11, the first air pipe 22 intercommunicate with the first air hole 13 and the mounting hole 14.

Furthermore, the outer diameter of the non-woven fabrics 21 is equal to the inner diameter of the receiving chamber 11, making the liquid conductive body 20 available of being received in the receiving chamber 11, and making the liquid conductive body 20 available of abutting against the liquid conductive holes 12 so the tobacco liquid may flow into the liquid conductive body 20 better, as well as reducing the phenomenon of tobacco liquid leakage and improve yield of the electronic cigarette production. Meanwhile, by stacking the non-woven fabrics 21 in fixed dimension, a liquid conductive body 20 is formed which is beneficial for automation production and improving the production efficiency.

Furthermore, the tightness of the compressed liquid conductive body 20 is related to the number of the non-woven fabrics 21. Under the circumstance that a space between the compression member 40 and the receiving chamber 11 is fixed, the more the number of the non-woven fabrics 21, the tighter the liquid conductive body 20 becomes after compressed by the compression member 40. Due to the compression effect of the compression member 40, close contact among adjacent layers of non-woven fabrics 21 may prevent the tobacco liquid leaking through adjacent layers of non-woven fabrics 21.

Understandable, when the liquid conductive body 20 is assembled, each circular non-woven fabric 21 is successively loaded into the receiving chamber 11 of the shell 10, then the compression member 40 is loaded into the mounting hole 14, and the circular non-woven fabrics 21 are compressed into the receiving chamber 11, to fulfill the assembly of the liquid conductive body 20.

As shown in FIG. 2 and FIG. 3, the heating element 30 is a spiral heating coil that is made by winding a set of one or two or even more metal heating wire. In the embodiment, to increase the heating efficiency, the heating coil is made by winding two heating wires to a spiral shape, and adjacent heating wire sets have an equipollent distance. Preferably, the metal heating wire is made by Nickel, Iron-Nickel alloy or Iron-Chromium-Aluminum alloys. Of course, in some alternative embodiments, the heating coil is other singular heating wire with comparatively high electric resistivity and may be made by loosely winding, making the heating power comparatively small.

The heating coil is disposed in the first air pipe 22 of the liquid conductive body 20, surrounded by the liquid conductive body 20. The liquid conductive body 20 conducts the tobacco liquid to the heating coil for heating to generate an aerosol. As used herein, the outer diameter of the heating coil is equal to the diameter of the first air pipe 22, making the heating coil to contact with the liquid conductive body 20, which is beneficial for the heating coil to heat the tobacco liquid in the liquid conductive body 20.

Furthermore, a second air hole 33 is bored at a middle of the heating coil, the second air hole 33 and the first air hole 13 intercommunicate with the mounting hole 14. The aerosol generated by the heating coil flows from the second air hole 33 to the first air hole 13, drawn by the user through the first air hole 13.

The heating coil further includes an anode terminal 31 and a cathode terminal 32, the anode terminal 31 and the cathode terminal 32 are coupled with the power supply to make the heating coil working.

As shown in FIG. 2 and FIG. 3, the compression member 40 includes a compression main body 41 having a tube-shaped structure, with a receiving hole 44 formed at a central part thereof. An end of an outer wall of the compression main body 41 protrudes to form a connecting part 42, an outer diameter of the connecting part 42 is equal to an outer diameter of the shell 10. An opposite end of the outer wall of the compression main body 41 protrudes to form a compression part 43, an outer diameter of the compression part 43 is equal to an inner diameter of the shell 10. When the compression member 40 is mounted in the mounting hole 14, the compression part 43 is rivet connected with the shell 10 to control the depth of the compression member 40 inserted in the mounting hole 14, which can adjust the volume of the liquid conductive body 20. Generally speaking, the compression member 40 is entirely loaded into the mounting hole 14, at that time, the connecting part 42 abuts against a bottom of the shell 10. By setting different depths of the compression member 40 inserted in the mounting hole 14, different volumes of the liquid conductive body 20 are obtained.

The compression member 40 is made by insulation materials, which may be a rubber ring configured for separating the anode terminal 31 from the cathode terminal 32.

When the compression member 40 is loaded in the mounting hole 14, the axis of the receiving hole 44 is coaxial with the receiving chamber 11. Moreover, the anode terminal 31 of the heating coil is disposed outside the compression member 40, and the cathode terminal 32 is disposed inside the receiving hole 44.

In some embodiments, a plug may be added between the compression member 40 and the liquid conductive body 20 to compress the volume of the liquid conductive body 20.

As shown in FIG. 2 and FIG. 3, the shape of the filtering net 50 is the same as the shape of the non-woven fabric 21, the filtering net 50 is disposed between the liquid conductive body 20 and the circular stopper 16. When the diameter of the central hole of the circular stopper 16 is larger than the diameter of the first air pipe 22, it can prevent tobacco liquid from flowing to the first air hole 13 via the central hole 161, which effectively avoids the user to draw the tobacco liquid from the first air hole 13.

As shown in FIG. 2 and FIG. 3, the cathode ring 60 includes a cathode main ring 61, the cathode main ring 61 is a tube-shaped structure, a diameter thereof is larger than a diameter of the receiving hole 44 and less than an outer diameter of the connecting part 42 of the compression member 40.

A cavity (not shown) is formed inside the cathode main ring 61.

A side wall of the cathode main ring 61 has an airflow hole 611, the airflow holes 611 are bored around the cathode main ring 61 symmetrically, intercommunicating with the cavity, allowing exterior air to flow into the cavity. Preferably, the number of the airflow holes 611 is four, which may allow exterior air to flow into the cavity.

An upper surface of the cathode main ring 61 extends upwards emerging as an extending part (not shown), a diameter of the extending part is less than a diameter of the cathode main ring 61, in this case, a first connecting part is formed on the cathode main ring 61, the cathode ring 60 is fixed with the compression member 40 via the first connecting part. The diameter of the extending part is less than that of the receiving hole 44, so when the cathode ring 60 is connected with the compression member 40, the extending part is properly received in the receiving hole 44.

A central of the extending part is provided with a second air pipe 62, the second air pipe 62 intercommunicates with the cavity.

When the cathode ring 60 is fixed with the compression member 40 via the first connecting part, the extending part is received in the receiving hole 44, meanwhile, the cathode terminal 32 of the heating coil is connected with the cathode ring 60. By replying on the cathode ring 60 contacts the power supply, the cathode terminal 32 of the heating coil is electrically connected with the cathode terminal of the power supply. Moreover, the second air pipe 62 is corresponding with the first air pipe 22, the airflow holes 611, the cavity, the second air pipe 62, the second air hole 33 and the first air hole 13 come to be an air passage. When the user draw the electronic cigarette, exterior air flows into the cavity via the airflow holes 611, flowing to the second air pipe 62 through the cavity, then flowing into the second air hole 33 of the heating coil via the second air pipe 62, carrying the aerosol generated by the heating coil heating the tobacco liquid to the first air hole 13, eventually drawn by the user via the first air hole 13.

Of course, in some embodiments, the diameter of the extending part is equal to the diameter of the receiving hole 44, when the cathode ring 60 is connected with the compression member 40, the extending part is rivet connected with the receiving hole 44.

Understandable, when the heating device 1 is assembled, firstly assembling the heating coil into the receiving chamber 11 of the shell 10, the second air hole 33 of the heating coil is coaxial with the first air hole 13; secondly, assembling the filtering net 50 in the receiving chamber 11 via the mounting hole 14 then the filtering net 50 is sleeved on the heating coil, meanwhile, the filtering net 50 abuts against the annular stopper 16; next, assembling each non-woven fabric 21 into the receiving chamber 11 through the mounting hole 14 that the non-woven fabrics 21 are sleeved on the heating coil; then assembling the compression member 40 into the mounting hole 14, the compression part 43 of the compression member 40 is assembled into the liquid conductive body 20 that is made by annular non-woven fabrics 21 in the receiving chamber 11, the connecting part 42 of the compression member 40 abuts against the bottom of the shell 10; meanwhile, one end of the liquid conductive body 20 abuts against the filtering net 50, an opposite end of the liquid conductive body 20 abuts against the compression member 40, and the side wall of the liquid conductive body 20 contacts the liquid conductive hole 12; eventually assembling the extending part of the cathode ring 60 into the receiving hole 44 of the compression member 40, as well as fixing the first connecting part of the cathode ring 60 with the bottom of the compression member 40, finally the heating device 1 is assembled successfully.

Additional aspects and advantages of the present disclosure will be: comparing with the prior art, the present disclosure relates to a heating device, an atomizer and an electronic cigarette having same. The heating device includes: a shell, a heating element and a liquid conductive body. The shell has a receiving chamber formed therein. The heating element is received in the receiving chamber and contacts with the liquid conductive body. The liquid conductive body is configured for absorbing tobacco liquid and supplying the tobacco liquid to the heating element. The liquid conductive body includes multiple annular liquid conductive layers stacked inside the shell along an axial direction of the shell, by making the outer diameter of multiple annular liquid conductive layers equal to the inner diameter of the receiving chamber, the annular liquid conductive layers are capable to be received in the receiving chamber and abut against the inner wall of the shell, which reduces the phenomenon that the liquid conductive body is too thick or too thin, resulting in improving the yield of the electronic cigarettes over time. And the method of manufacturing the liquid conductive body by stacking non-woven fabrics in fixed size is beneficial for automatic production, thus improving production efficiency.

Embodiment 2

Figure 4:
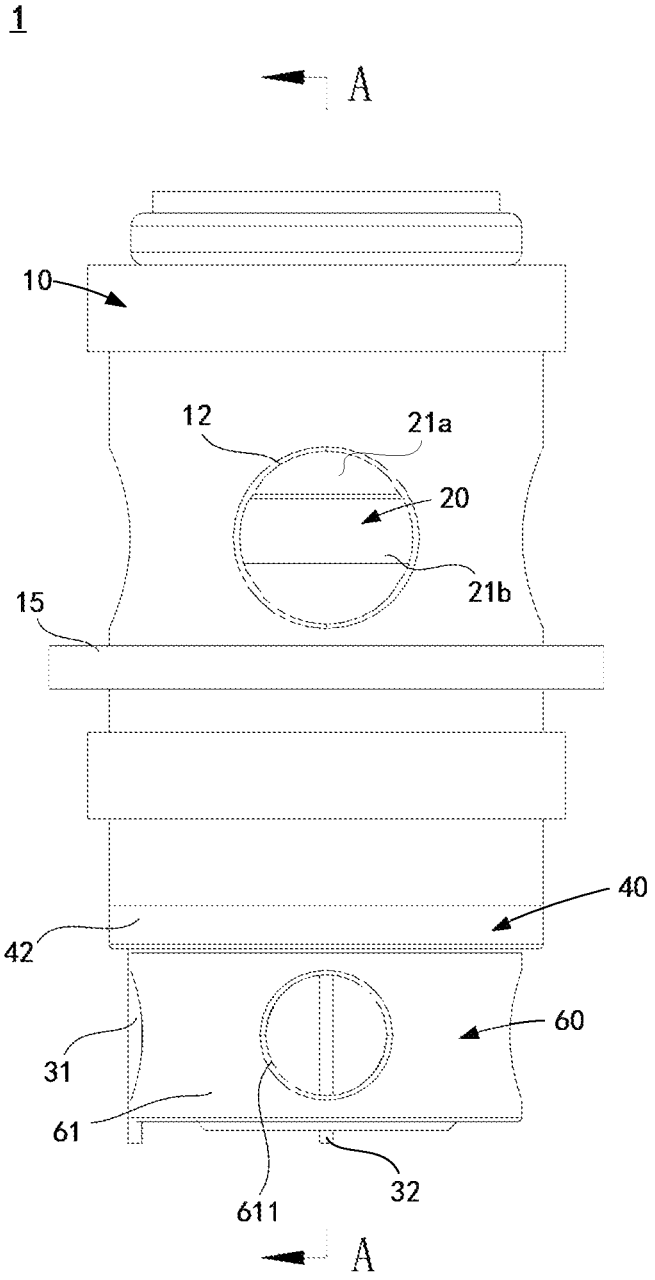
FIG. 4 is a structural view of the heating device in accordance with a second embodiment of the present disclosure.
Figure 5:
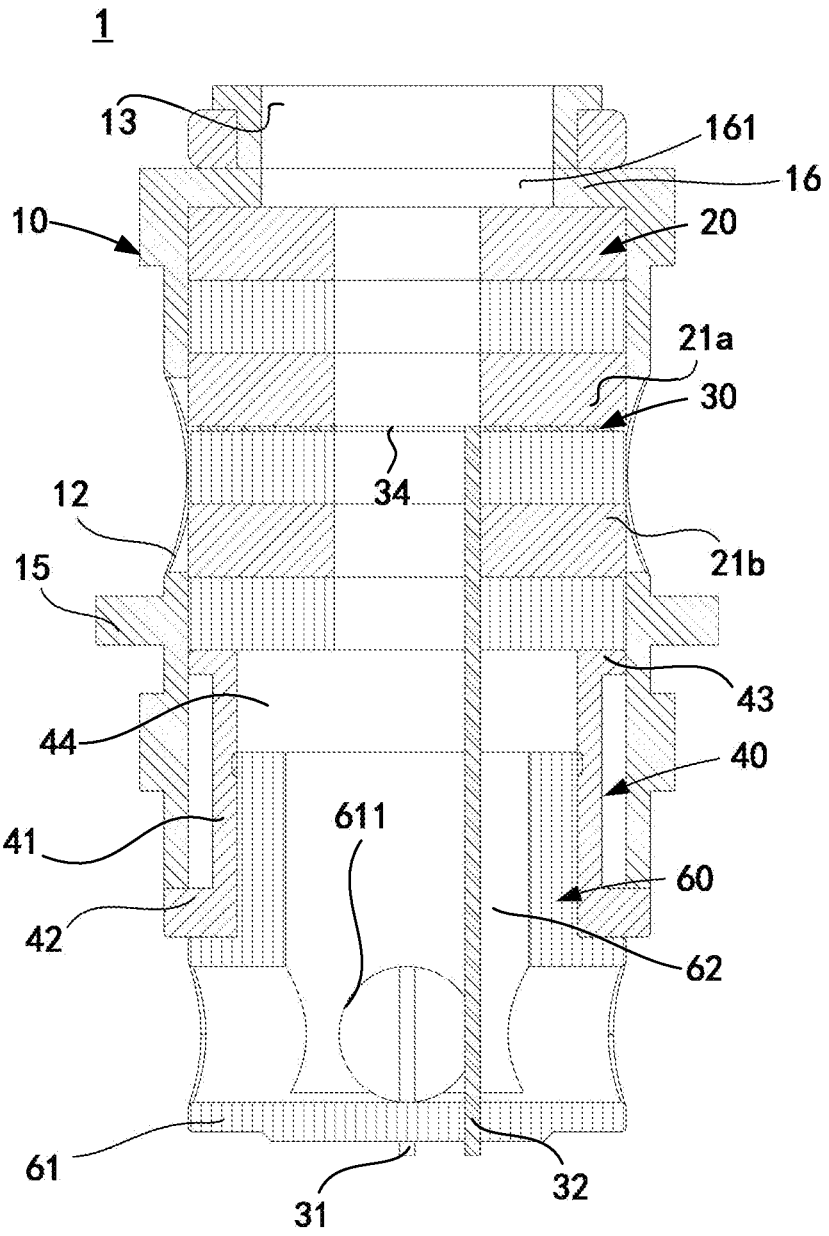
FIG.5 is a cross-sectional view of the heating device along the A-A direction in FIG. 4.
Figure 6:
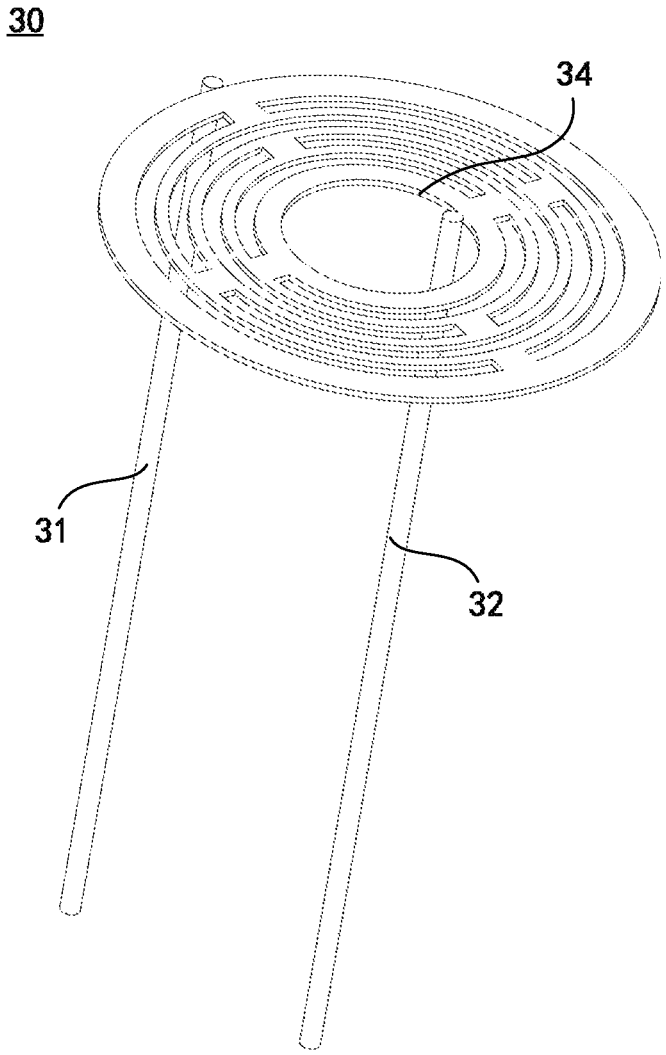
FIG. 6 is an isometric view of a heating element in the heating device in FIG. 4.

As shown in FIG. 4 to FIG. 6, which are structural views of the heating device in accordance with embodiments of the present disclosure. As applied to the atomizer, the heating device 1 is basically the same as Embodiment 1, the same technical schemes refer to Embodiment 1, no description hereinafter.

As shown in FIG. 5 and FIG. 6, in embodiments of the present disclosure, the differential points are that the heating element 30 is a disk-shaped heating piece, the circular non-woven fabrics 21 at least includes a first circular non-woven fabric 21*a* and a second circular non-woven fabric 21*b*, the disk-shaped heating piece is clamped between the first circular non-woven fabric 21*a* and the second circular non-woven fabric 21*b*.

More specifically, as shown in FIG. 5, the first circular non-woven fabric 21*a* is a non-woven fabric with comparatively good tobacco liquid conductivity, which is received in an end of the receiving chamber 11 closer to the first air hole 13. The second circular non-woven fabric 21*b* is a non-woven fabric with comparatively good tobacco liquid conductivity, which is received in an end of the receiving chamber 11 closer to the mounting hole 14, thus effectively avoiding the leakage of tobacco liquid.

As used herein, the number of the first circular non-woven fabrics 21*a* is the same as the number of the second circular non-woven fabrics 21*b*, thus when the disk-shaped heating piece is clamped between the first circular non-woven fabrics 21*a* and the second circular non-woven fabrics 21*b*, the disk-shaped heating piece is at the middle of the liquid conductive body 20.

Of course, in some embodiments, the number of the first circular non-woven fabrics 21*a* may be different from the number of the second circular non-woven fabrics 21*b*.

As shown in FIG. 6, the disk-shaped heating piece is disk-shaped ceramic heating piece, an outer diameter thereof is less than an outer diameter of the non-woven fabric 20. A third air hole 34 is bored at a central of the disk-shaped heating piece.

Multiple sets of annular heating slots (not shown) are provided on the disk-shaped heating piece, each annular heating slot includes two heating slots (not shown), both are disposed symmetrically. Multiple sets of annular heating slots are concentric along the third air hole 34. The diameters thereof are gradually increasing away from the third air hole 34, and adjacent sets of circular heating slots are staggered with each other to 90 degree, which may enlarge the heating area of the disk-shaped heating piece, meanwhile, making the disk-shaped heating piece heat even.

The disk-shaped heating piece further includes an anode terminal 31 and a cathode terminal 32, the cathode terminal 32 is disposed on inside wall of the third airhole 34. The anode terminal 31 is disposed on outside wall of the disk-shaped heating piece, enabling the anode terminal 31 and the cathode terminal 32 to be separated by the compression member 40.

Furthermore, the third air hole 34 has the same diameter with the first air pipe 22. When the disk-shaped heating piece is clamped between the first annular non-woven fabric 21*a* and the second annular non-woven fabric 21*b*, the third air hole 34 is corresponding with the first air pipe 22. The disk-shaped heating piece heats the tobacco liquid to generate an aerosol passing through the third air hole 34 and entering into the first air pipe 22, then flowing into the first air hole 13 via the first air pipe 22, eventually drawn by the user from the first air pipe 22.

Understandable, when the heating device 1 is assembled, firstly assembling the filtering net 50 into the receiving chamber 11 from the mounting hole 14, at this time the filtering net 50 abuts against the annular stopper 16; then assembling each first annular non-woven fabrics 21*a* to the receiving chamber 11 from the mounting hole 14; afterwards assembling the disk-shaped heating piece into the receiving chamber 11 from the mounting hole 14 such that the third air hole 34 is corresponding with the first air pipe 22; then assembling the second circular non-woven fabrics 21*b* successively to the receiving chamber 11 from the mounting hole 14; and then assembling the compression member 40 into the mounting hole 14, the compression part 43 of the compression member 40 compresses the second annular non-woven fabrics 21*b* in the receiving chamber 11 to form a desired volume of the liquid conductive body 20, the connecting part 42 of the compression member 40 abuts against the bottom of the shell 10, at this time, an end of the liquid conductive body 20, that is the first annular non-woven fabric 21*a,* abuts against the filtering net 50; and an opposite end of the liquid conductive body 20, that is the second annular non-woven fabrics 21*b* abuts against the compression member 40. While the side wall of the liquid conductive body 20 contacts with the liquid conductive hole 12. Eventually assembling the extending part of the cathode ring 60 into the receiving hole 44 of the compression member 40 then the first connecting part of the cathode ring 60 is fixedly connected with the compression member 40. At this time, the cathode terminal 32 of the disk-shaped heating piece is connected with a cathode main ring 61 via the first air pipe 22, the second air pipe 62 and the cathode main ring 61 to finish the assembling of the heating device 1.

Additional aspects and advantages of the present disclosure will be: comparing with the prior art, the present disclosure relates to a heating device, an atomizer and an electronic cigarette having same. The heating device includes: a shell, a heating element and a liquid conductive body. The shell has a receiving chamber formed therein. The heating element is received in the receiving chamber and contacts with the liquid conductive body. The liquid conductive body is configured for absorbing tobacco liquid and supplying the tobacco liquid to the heating element. The liquid conductive body includes multiple annular liquid conductive layers stacked inside the shell along an axial direction of the shell, by making the outer diameter of multiple annular liquid conductive layers equal to the inner diameter of the receiving chamber, the annular liquid conductive layers are capable to be stacked in the receiving chamber and abut against the inner wall of the shell, which reduces the phenomenon that the liquid conductive body is too thick or too thin, resulting in improving the yield of the electronic cigarettes over time. And the method of manufacturing the liquid conductive body by stacking non-woven fabrics in fixed size is beneficial for automatic production, thus improving production efficiency.

Embodiment 3

In accordance with embodiments of the present disclosure, an atomizer is disclosed, the atomizer (not shown) includes a case (not shown) and the aforementioned heating device 1, the heating device 1 is received in the case and fixedly connected with the case.

More specifically, the case and the clamping part 15 of the shell 10 of the heating device 1 are sealed with a sealing ring.

Furthermore, the case has a liquid storage chamber formed therein, the heating device 1 is received in the case and is capable to obtain tobacco liquid for heating.

The liquid storage chamber may also be disposed around a periphery of the heating device 1, in some embodiments, the liquid storage chamber is at the upper or lower of the heating device.

Embodiment 4

In accordance with embodiments of the present disclosure, an electronic cigarette is disclosed. The electronic cigarette (not shown) includes a power supply module (not shown) and the aforementioned atomizer (not shown). An cathode terminal of the power supply module contacts the cathode ring 60 of the atomizer. An anode terminal of the power supply module is electrically connected with the anode terminal 31 of the heating element 30.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. A heating device comprising:

a shell, with a receiving chamber formed therein;

a heating element received in the receiving chamber; a liquid conductive body in contact with the heating element, the liquid conductive body being configured for absorbing tobacco liquid and supplying the tobacco liquid to the heating element; the liquid conductive body comprises multiple annular liquid conductive layers stacked inside the shell, along an axial direction of the shell; outer diameters of multiple annular conductive layer are equal to an inner diameter of the receiving chamber such that the multiple annular liquid conductive layers are capable of being assembled in the receiving chamber and abutting against an inner surface of the shell.

2. The heating device of claim 1, wherein the annular liquid conductive layers are annular non-woven fabrics; and each annular non-woven fabric comprises an air hole, multiple air holes of multiple non-woven fabrics intercommunicate to emerge as a first air passage extending an axial direction of the shell.

3. The heating device of claim 2, wherein the heating element is a heating coil; the heating coil is disposed inside the first air passage.

4. The heating device of claim 2, wherein the heating element is a disk-shaped heating piece with a third air hole thereon; the annular non-woven fabrics at least comprise a first annular non-woven fabric and a second annular non-woven fabric; the disk-shaped heating piece is clamped between the first annular non-woven fabric and the second annular non-woven fabric, and the third air hole intercommunicate with the first air passage.

5. The heating device of claim 1, wherein a liquid conductive hole is bored on a sidewall of the shell; the liquid conductive hole contacts with the liquid conductive body and is configured for supplying tobacco liquid to the liquid conductive body.

6. The heating device of claim 1, wherein two ends of the shell respectively have a first air hole and a mounting hole, the first air hole and the mounting hole intercommunicate with the receiving chamber; the heating device further comprises: a compression member; the compression member is mounted in the mounting hole and abuts against one end of the liquid conductive body, configured for compressing the liquid conductive body to adjust a volume of the liquid conductive body.

7. The heating device of claim 6, wherein the shell further comprises:

a annular stopper;

the annular stopper is disposed inside the receiving chamber, one end of the liquid conductive body abuts against the annular stopper, and an opposite end thereof abuts against the compression member; the first air hole is corresponding with a central hole of the annular stopper.

8. The heating device of claim 7, wherein the heating device further comprises:

a filtering net;

the filtering net is disposed between the liquid conductive body and the annular stopper, corresponding with the annular non-woven fabrics, the filtering net is configured for preventing the tobacco liquid from flowing into the first through hole.

9. The heating device of claim 8, wherein the heating device further comprises an anode ring; the anode ring is connected with the compression member.

10. An atomizer comprising:

a case, with a liquid storage chamber formed therein; and a heating device, received in the case; the heating device is capable of receiving tobacco liquid from the liquid storage chamber and heating the tobacco liquid;

the heating device comprising:

a shell, with a receiving chamber formed therein;

a heating element, received in the receiving chamber to contact with a liquid conductive body; and the liquid conductive body, configured for absorbing tobacco liquid and supplying the tobacco liquid to the heating element; the liquid conductive body comprising multiple annular liquid conductive layers stacked inside the shell, along an axial direction of the shell; outer diameters of multiple annular conductive layer being equal to an inner diameter of the receiving chamber such that the multiple annular liquid conductive layers are capable of being assembled in the receiving chamber and abutting against an inner surface of the shell.

11. The atomizer of claim 10, wherein the annular liquid conductive layers are annular non-woven fabrics; and each annular non-woven fabric comprises an air hole, multiple air holes of multiple non-woven fabrics intercommunicate to emerge as a first air passage extending an axial direction of the shell.

12. The atomizer of claim 11, wherein the heating element is a heating coil; the heating coil is disposed inside the first air passage.

13. The atomizer of claim 11, wherein the heating element is a disk-shaped heating piece with a third air hole thereon; the annular non-woven fabrics at least comprise a first annular non-woven fabric and a second annular non-woven fabric; the disk-shaped heating piece is clamped between the first annular non-woven fabric and the second annular non-woven fabric, and the third air hole intercommunicate with the first air passage.

14. The atomizer of claim 10, wherein a liquid conductive hole is bored on a sidewall of the shell; the liquid conductive hole contacts with the liquid conductive body and is configured for supplying tobacco liquid to the liquid conductive body.

15. The atomizer of claim 10, wherein two ends of the shell respectively have a first air hole and a mounting hole, the first air hole and the mounting hole intercommunicate with the receiving chamber; the heating device further comprises: a compression member; the compression member is mounted in the mounting hole and abuts against one end of the liquid conductive body, configured for compressing the liquid conductive body to adjust a volume of the liquid conductive body.

16. The atomizer of claim 15, wherein the shell further comprises:

a annular stopper;

the annular stopper is disposed inside the receiving chamber, one end of the liquid conductive body abuts against the annular stopper, and an opposite end thereof abuts against the compression member; the first air hole is corresponding with a central hole of the annular stopper.

17. The atomizer of claim 16, wherein the heating device further comprises:

a filtering net;

the filtering net is disposed between the liquid conductive body and the annular stopper, corresponding with the annular non-woven fabrics, the filtering net is configured for preventing the tobacco liquid from flowing into the first through hole.

18. The atomizer of claim 17, wherein the heating device further comprises an anode ring; the anode ring is connected with the compression member.

19. An electronic cigarette comprising a power supply module; and an atomizer comprising:

a case, with a liquid storage chamber formed therein; and a heating device, received in the case; the heating device being capable of receiving tobacco liquid from the liquid storage chamber and heating the tobacco liquid;

the heating device comprising:

a shell, with a receiving chamber formed therein;

a heating element, received in the receiving chamber to contact with a liquid conductive body; and the liquid conductive body, configured for absorbing tobacco liquid and supplying the tobacco liquid to the heating element; the liquid conductive body comprising multiple annular liquid conductive layers stacked inside the shell, along an axial direction of the shell; outer diameters of multiple annular conductive layer being equal to an inner diameter of the receiving chamber such that the multiple annular liquid conductive layers are capable of being assembled in the receiving chamber and abutting against an inner surface of the shell;

the atomizer being coupled with the power supply module via the heating element.

* * * * *